US005911396A

United States Patent [19]

Bireley

[11] Patent Number: 5,911,396

[45] Date of Patent: Jun. 15, 1999

[54] CLOSET GUITAR HANGER

[76] Inventor: David R. Bireley, 412 Woodcrest Dr., Lancaster, Pa. 17602

[21] Appl. No.: 09/012,656

[22] Filed: Jan. 23, 1998

[51] Int. Cl.[6] ..... B42F 13/00

[52] U.S. Cl. ..... 248/340; 84/327; 211/113; 248/317; D6/567

[58] Field of Search ..... 248/340, 317, 248/327, 333, 326, 312, 304, 301, 215; 211/113, 117, 118, 207, 175; 84/327, 453; D6/527, 525

[56] References Cited

U.S. PATENT DOCUMENTS

| | | | |
|---|---|---|---|
| D. 271,848 | 12/1983 | Tcherneshoff | D8/373 |
| D. 308,782 | 6/1990 | Getsi | D6/567 |
| D. 329,349 | 9/1992 | Moreno | D6/567 |
| 1,294,916 | 2/1919 | Knight | 211/87.01 |
| 2,601,926 | 7/1952 | Speaker et al. | 211/113 |
| 4,078,753 | 3/1978 | Cole | 248/204 |
| 4,094,488 | 6/1978 | Bryant | 248/359 |
| 4,108,084 | 8/1978 | Fink | 108/29 |
| 4,345,732 | 8/1982 | Gallegos | 248/441 B |
| 4,352,480 | 10/1982 | Gathright | 248/443 |
| 4,811,646 | 3/1989 | Hoshino | 84/313 |
| 5,224,607 | 7/1993 | Koresko | 211/34 |
| 5,346,168 | 9/1994 | Astrella | 248/278 |
| 5,372,346 | 12/1994 | Upchurch et al. | 248/304 |
| 5,620,105 | 4/1997 | Macek | 211/119 |

*Primary Examiner*—Ramon O. Ramirez
*Assistant Examiner*—Anita M. King
*Attorney, Agent, or Firm*—Goldstein & Canino

[57] ABSTRACT

A closet guitar hanger system, for storing at least one guitar having a neck and a head, in a closet having a closet rod, comprising a frame and a cradle attached to the frame. The frame comprises an upper frame and lower frame which are adjustable with respect to each other for accommodating guitars having different sized heads. The frame has a closet rod cache for hanging from a standard closet rod. The cradle comprises a c-curve for accommodating the neck, and a pair of supporting members for supporting the head. Spacer rods extend horizontally into spacer rod holes in the frame for separating a plurality of guitar hangers from each other while located on the same closet rod, for preventing guitars supported by said guitar hangers from touching each other.

8 Claims, 3 Drawing Sheets

CLOSET GUITAR HANGER

BACKGROUND OF THE INVENTION

The invention relates to a closet guitar hanger. More particularly, the invention relates to a modular system for hanging a single guitar, or a plurality of guitars in a closet having an ordinary closet rod.

A guitar is a musical instrument quite different from a piano: its possible to have more than one guitar. In fact, many guitar players own several instruments. At the very least, a typical guitar player owns at least one acoustic and one electric guitar. However, collectors may own several dozen guitars.

Owning several guitars presents storage problems. Even though the guitar itself isn't that bulky, typical guitar cases add greatly to the overall bulk, and do not allow stacking with other guitars. Further, if using a soft case, it is not desirable to store any other objects on top of the case. Thus, the prospect of owning and storing many guitars either means having them occupy a great deal of storage space, or compromising the care given to each guitar by cramming them all into a small space.

Besides storage in cases, a suitable guitar storage method involves hanging a guitar flush against a wall surface using pegs that support the head of the guitar. This is a common practice in guitar stores. However, in the home, large scale storage of guitars on the wall certainly makes a decorating statement, but perhaps not one that a person would wish to make. In addition, such open storage simply advertises the location and extent of one's collection to a would-be thief.

U.S. Pat. Nos. 4,345,732 to Gallegos and 5,346,168 to Astrella both disclose different guitar hanging brackets which would typically extend from the side of a road case. These devices are only suited for suspending a single guitar temporarily during a performance.

U.S. Pat. No. 4,352,480 to Gathright discloses a double guitar stand. Gathright allows a guitar player to have two guitars at their ready during a performance. Gathright however, does not seek to economize storage space. In contrast, Gathright is most concerned with providing the guitar player with the ability to quickly select and grab one of the guitars when desired.

U.S. Pat. No. 4,094,488 to Bryant discloses a hanger for tennis rackets. Bryant attaches upon a typical closet rod, and supports a tennis racket around the frame. Bryant is particularly designed and suited for supporting tennis rackets.

While these units may be suitable for the particular purpose employed, or for general use, they would not be as suitable for the purposes of the present invention as disclosed hereafter.

SUMMARY OF THE INVENTION

It is an object of the invention to produce a closet guitar hanger system which provides support for at least one guitar on a standard guitar closet rod.

It is another object of the invention to allow storage of several guitars using a minimal amount of closet space.

It is a further object of the invention that each guitar hanger is inexpensive to manufacture.

It is yet a further object of the invention that the closet guitar hanging system stores each guitar in such a manner that they are well protected from damage.

The invention is a closet guitar hanger system, for storing at least one guitar having a neck and a head, in a closet having a closet rod, comprising a frame and a cradle attached to the frame. The frame comprises an upper frame and lower frame which are adjustable with respect to each other for accommodating guitars having different sized heads. The frame has a closet rod cache for hanging from a standard closet rod. The cradle comprises a c-curve for accommodating the neck, and a pair of supporting members for supporting the head. Spacer rods extend horizontally into spacer rod holes in the frame for separating a plurality of guitar hangers from each other while located on the same closet rod, for preventing guitars supported by said guitar hangers from touching each other.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
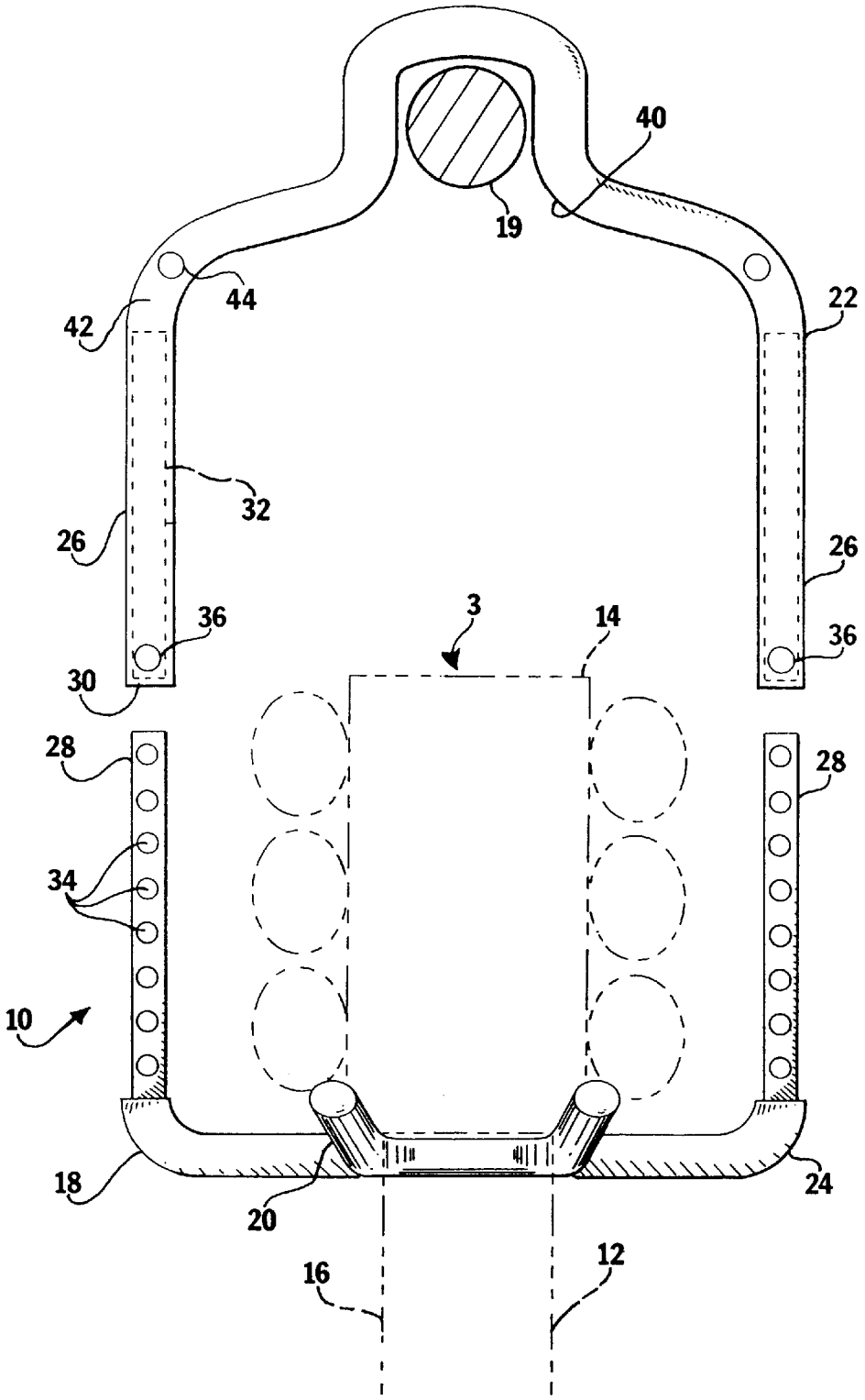
FIG. 1 is a front elevational view, illustrating the guitar hanger in a state of partial disassembly, with the position of a guitar potentially supported thereby illustrated in phantom.

FIG. 1 illustrates a guitar hanger 10. The guitar hanger 10 supports a guitar 12, illustrated in phantom. The guitar has a head 14 and a neck 16. The guitar hanger 10 comprises a frame 18 and a cradle 20. The cradle 20 directly supports the head 14 of the guitar 12 at the junction between the head 14 and neck 16. The frame 18 is supported by a standard closet rod 19.

The frame 18 comprises an upper frame 22 and a lower frame 24 which attach to each other to form a closed loop. The upper frame 22 has a pair of parallel upper prongs 26, and the lower frame 24 has a pair of parallel lower prongs 28. Each of the upper prongs 26 has an upper prong bottom 30 and a upper prong bore 32 which extends into the upper prong bottom 30 longitudinally along the upper prong 26, parallel to the other upper prong 26. The upper prongs 26 and lower prongs 28 are telescopically attached to each other for varying the relative vertical positions of the upper frame 22 and lower frame 24. The lower prongs 28 extend into the upper prong bores 32 for adjusting the relative position of the upper frame with respect to the lower frame.

The lower frame 24 has a plurality of adjustment holes 34 in the lower prongs 28 spaced longitudinally thereon for fixing the upper frame and lower frame at different positions or heights for storage of guitars having different sized heads. The upper frame has a fixing hole 36 on each of the upper prongs 26, which extends into the upper prong bore 32. Thus, once a suitable relative position of the lower frame 24 with respect to the upper frame 22 is selected, a pair of fixing pins 38, illustrated in FIG. 2, are inserted through the fixing hole 36 in each of the upper prongs 26 and through one of the adjustment holes 34 in the corresponding lower prong 28 extending in the upper prong bore 32.

The upper frame 22 comprises a closet rod cache 40 for supporting the frame 12 by the closet rod 19, which comprises a quadruple bend in the upper frame 22, for accommodating standard closet rods, and preferably contacting the closet rod 19 at three tangential points.

The upper frame comprises a front face 42, which has at least one spacer rod hole 44 that extends partially into the upper frame 22 from the front face 42. Referring to FIG. 2, spacer rods 46 extend horizontally into the spacer rod holes 44 for allowing two guitar holders 10 to be placed on the closet rod 19 adjacent to one another while preventing the guitars 12 supported thereby from touching each other.

Figure 2:
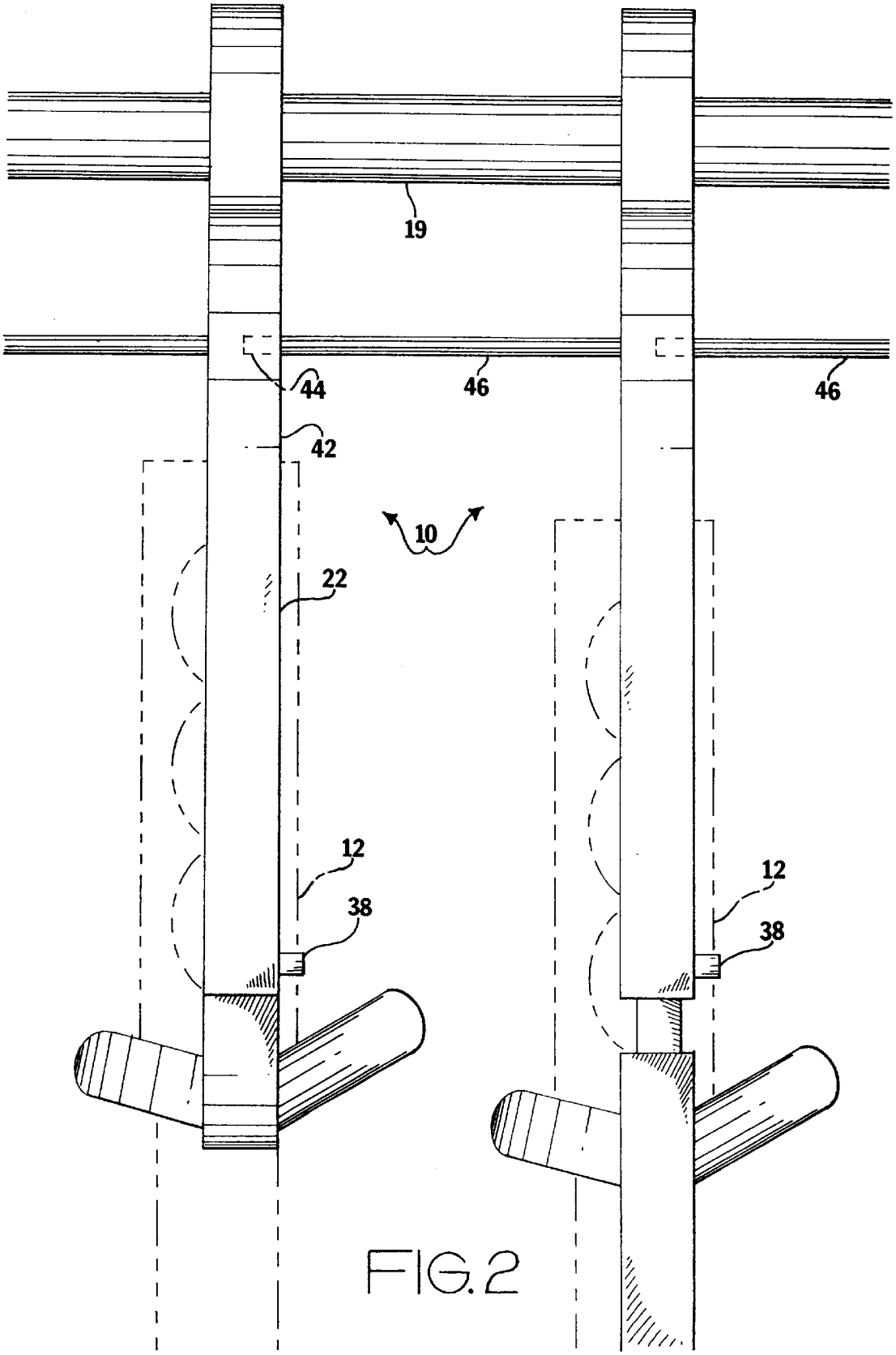
FIG. 2 is a side elevational view illustrating two guitar hangers situated adjacent each other, each supporting a guitar that is illustrated herein in phantom.

Also illustrated in FIG. 2, the upper frame 22 and lower frame 24 are at different relative positions for each of the guitar hangers 10 depicted.

Figure 4:
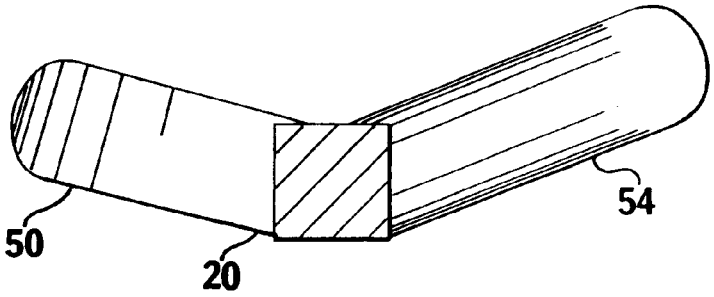
FIG. 4 is a cross sectional view, taken in the direction of line 4—4 in FIG. 3.
Figure 3:
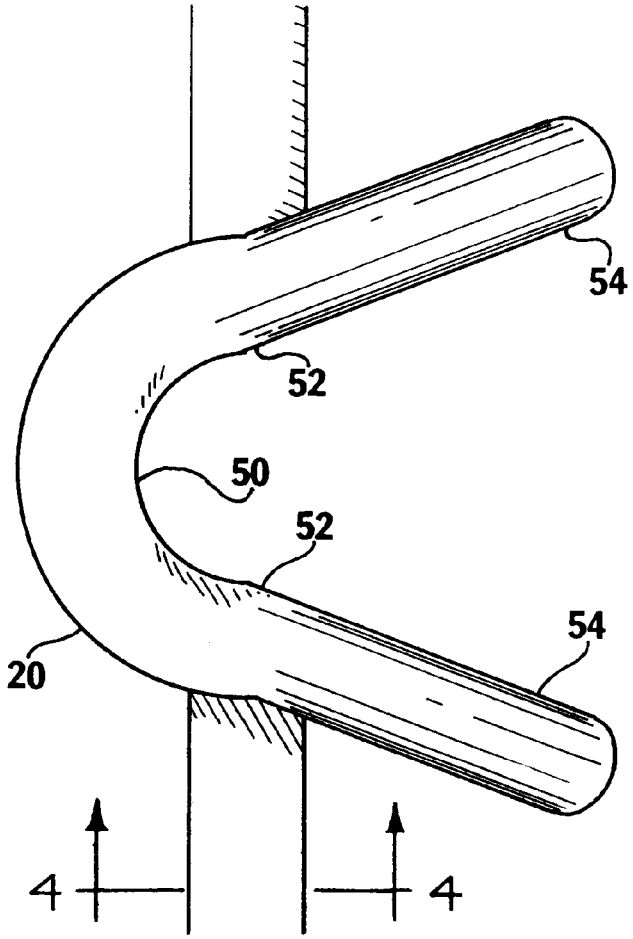
FIG. 3 is an enlarged top plan view with parts broken away, taken generally in the direction of arrow 3 in FIG. 1.

FIG. 3 and FIG. 4 further illustrate the cradle 20. The cradle comprises a c-curve 50 having two ends 52, and a pair of support arms 54 extending outward from the ends 52. The support arms 54 form an acute angle with each other. When supporting a guitar, the c-curve 50 accommodates the curvature of the neck as nearly as possible, and the support arms 54 support the head. Typically, the cradle 20 will be coated or lined with rubber to cushion the neck and head.

It is interesting to note that once a guitar is supported on the guitar hanger, the guitar can be protected from dust by using a common clear plastic dry cleaning bag. The dry cleaning bag is simply inserted over the hanger and guitar just as it would be inserted over a garment on a hanger. Once the guitar hanger is on the closet rod, the bag is held in place by the closet rod. Similarly, plastic zipper garment bags may also be used with the guitar hanger as a make-shift case to provide further protection of the guitar against scuffs and nicks.

In conclusion, herein is presented a guitar hanging system which allows a collection of guitars to be stored in a closet on a standard closet rod, occupying only minimal space.

What is claimed is:

1. A guitar hanger, for hanging a guitar having a neck and head on a closet rod, comprising:

a frame, having a closet rod cache for supporting the frame by the closet rod, comprising an upper frame and a lower frame, the upper frame and lower frame forming a closed loop which is vertically adjustable to accommodate different sized guitar heads and;

a cradle attached to the frame, for supporting the guitar by its head.

2. The guitar hanger as recited in claim 1, wherein:

the upper frame comprises a pair of parallel upper prongs;

the lower frame comprises a pair of parallel lower prongs;

the upper prongs telescopically connected to the lower prongs for vertically adjusting their relative position; and further comprising at least one fixing pin for fixing the position of one of the upper prongs with respect to one of the lower prongs.

3. The guitar hanger as recited in claim 2, wherein each of the upper prongs has an upper prong bore, the lower prongs extend into the upper prong bores, the lower prongs have adjustment holes spaced longitudinally thereon, and each upper prong has a fixing hole to insert one of the fixing pins to engage with one of the adjustment holes to fix the relative position of the lower prong in the upper prong bore thus fixing the relative position of the upper frame with respect to the lower frame.

4. The guitar hanger as recited in claim 3, wherein the frame further has a front face which has at least one spacer rod hole that extends partially into the front face for inserting a spacer rod which extends horizontally from the frame and allows two guitar holder to be placed on the closet rod adjacent to one another while preventing guitars supported thereby from touching each other.

5. The guitar hanger as recited in claim 4, wherein the closet rod cache comprises a quadruple bend in the upper frame.

6. The guitar hanger as recited in claim 5, wherein the cradle further comprises:

a c-curve for accommodating the neck of the guitar; and a pair of support arms extending from the c-curve for supporting the head of the guitar.

7. The guitar hanger as recited in claim 6, wherein the support arms form an acute angle.

8. A guitar storage method for storing a guitar, having a head and a neck, in a closet having a closet rod, employing a plurality of guitar hangers, each having a front face having a spacer rod hole, further using spacer rods which fit in the spacer rod holes, and using a guitar hanging device comprising a frame having a closet rod cache and a cradle attached to the frame, comprising the steps of:

hanging the frame on the closet rod with the closet rod extending through the closet rod cache;

repeating the steps of hanging the frame and supporting the guitar for each of the plurality of guitar hangers and a plurality of guitars being stored;

placing spacer rods in the spacer rod holes between adjacent guitar hangers for preventing the guitars supported by the adjacent guitar hangers from touching each other; and supporting the guitar in the cradle by the head of the guitar.

* * * * *